US006164024A

United States Patent [19]

Konstantin

[11] Patent Number: 6,164,024

[45] Date of Patent: Dec. 26, 2000

[54] ARCHITECTURAL GLAZING PANEL SYSTEM AND RETAINING CLIP THEREFOR

[75] Inventor: Moshe Konstantin, Highland Park, Ill.

[73] Assignee: Konvin Associates Limited Partnership, Lake Forest, Ill.

[21] Appl. No.: 08/959,255

[22] Filed: Oct. 28, 1997

[51] Int. Cl.[7] ..... E04B 7/18

[52] U.S. Cl. ..... 52/200; 52/461; 52/469; 52/582.1; 52/588.1

[58] Field of Search ..... 52/200, 461, 469, 52/470, 471, 563, 582.1, 582.2, 584.1, 588.1

[56] References Cited

U.S. PATENT DOCUMENTS

| | | | |
|---|---|---|---|
| 1,141,445 | 6/1915 | Davison . | |
| 1,988,647 | 1/1935 | Emerson et al. | 52/469 X |
| 2,293,351 | 8/1942 | Meginnity . | |
| 2,312,994 | 3/1943 | Weitzel . | |
| 2,784,814 | 3/1957 | Bright | 52/461 X |
| 2,841,255 | 7/1958 | Kemp . | |
| 3,002,591 | 10/1961 | Hess . | |
| 3,022,869 | 2/1962 | Radek . | |
| 3,046,852 | 7/1962 | Graham . | |
| 3,257,758 | 6/1966 | Johnson . | |
| 3,290,850 | 12/1966 | Byrne et al. . | |
| 3,299,595 | 1/1967 | Munk . | |
| 3,386,221 | 6/1968 | Giovannucci . | |
| 3,421,276 | 1/1969 | La Barge . | |
| 3,984,961 | 10/1976 | Chieger et al. . | |
| 4,035,539 | 7/1977 | Luboshez . | |
| 4,057,936 | 11/1977 | Wyatt . | |

(List continued on next page.)

FOREIGN PATENT DOCUMENTS

| | | | |
|---|---|---|---|
| 47557 | 4/1974 | Australia | 52/584.1 |
| 1007773 | 5/1952 | France . | |
| 812130 | 7/1940 | Germany . | |
| 1690777 | 4/1970 | Germany . | |
| 1759662 | 6/1971 | Germany . | |
| 2125725 | 12/1972 | Germany . | |
| 2527013 | 2/1976 | Germany . | |
| 2802181 | 7/1979 | Germany . | |
| 482747 | 6/1939 | United Kingdom . | |
| 814250 | 6/1959 | United Kingdom . | |

OTHER PUBLICATIONS

Polyu Italiana S.p.A, C3/16—Self–Supporting Flat system, Systeme Plan Autoportant, (1996).

Polyu Italiana S.p.A, C2/10—Self–Supporting Flat system, Systeme Plan Autoportant, (1996).

Polyu Italiana S.p.A, C1/6—Self–Supporting Flat system, Systeme Plan Autoportant, (1996).

Polygal, The Logical Glazing Alternative, (1996).

Polygal, Aug. 1987, Polygal—Polyarbonate Structured Sheets.

Kalwall Corporation, 1988, The Daylighting Experience.

*Primary Examiner*—Richard Chilcot

*Attorney, Agent, or Firm*—Fitch, Even, Tabin & Flannery

[57] ABSTRACT

A high performance light transmissive glazing panel system is provided such as for overhead roof constructions which has a wind load resistance on the order of 330 psf. The glazing panels are supported on a framework of purlins and rafters and include upstanding seam flanges for connecting adjacent panels together with a batten joining connector. Retention clips are secured to the purlins with each having a central web extending between the seam flanges and elongated top flanges which abut the tops of the seam flanges over a distance that is equal to or greater than the transverse width of the purlin for improved holding power. The preferred clip is an integral extrusion and can take on a variety of forms in accordance with the invention. In each form, the clip top flange extends continuously from one side of the web to the other so as to be resistant to being bent upward on either side of the web. The clip can be extruded with thickened portions to increase its moment of inertia and resistance to bending for improved holding power and rigidity of the glazing panel system. In addition, the base of the clip can be integral with the supporting structure therebelow to reduce the need for distinct support members of the panel supporting framework.

27 Claims, 5 Drawing Sheets

U.S. PATENT DOCUMENTS

| | | | |
|---|---|---|---|
| 4,084,272 | 4/1978 | Laven . | |
| 4,135,342 | 1/1979 | Cotter | 52/461 |
| 4,193,232 | 3/1980 | Almstead et al. . | |
| 4,222,210 | 9/1980 | Hanstein et al. | 52/469 X |
| 4,223,493 | 9/1980 | Moench et al. . | |
| 4,242,849 | 1/1981 | Benkelman et al. . | |
| 4,299,070 | 11/1981 | Oltmanns et al. . | |
| 4,332,119 | 6/1982 | Toews . | |
| 4,573,300 | 3/1986 | Bezner . | |
| 4,998,395 | 3/1991 | Bezner . | |
| 5,348,790 | 9/1994 | Ben-Zvi et al. . | |
| 5,387,456 | 2/1995 | Ben-Zvi et al. . | |
| 5,845,446 | 12/1998 | Funkai et al. | 52/469 X |

ARCHITECTURAL GLAZING PANEL SYSTEM AND RETAINING CLIP THEREFOR

FIELD OF THE INVENTION

The invention relates to a high-performance architectural glazing panel system with improved wind load resistance.

BACKGROUND OF THE INVENTION

Glazing panel systems have found a wide variety of uses in the design of various architectural structures as they are a strong, lightweight alternative to the traditional material, glass, which they often replace. For instance, modular glazing panels can be used with a framing grid of purlins and rafters to form overhead or roofing structures such as for covered walkways, pool enclosures, building atriums, greenhouses, etc. Glazing panels generally have light transmissive properties so that their use is particularly preferred where it is desired to allow sunlight to pass through the structure such as to illuminate interior regions of a building. An additional advantage promoting the use of glazing panel systems is the energy conservation they afford.

Glazing panel systems used for roof and wall constructions must be capable of resisting both the static and dynamic loads as well as the impact loads to which they will be subjected, carrying them satisfactorily to the walls and/or other supporting structures and providing protection from the elements. Principle roof loads are created by high winds, and in the northern climates, by snow and ice. The evaluation of pressures exerted by wind on a building is complex, and local code requirements for wind forces can vary widely depending on the weather extremes expected in the area. The recommended design wind pressure on plane surfaces which are normal to the wind increases with the height of the structure above ground level. Wind on the windward roof slope may produce suction or pressure depending on the slope of the roof. Leeward slopes are generally always subject to the effects of suction.

Hurricanes bring high, swirling winds against building structures and can cause damage by penetrating building envelopes such as by breaking windows due to flying debris or high wind pressure allowing wind to rush into the building pressuring the interior thereof. The vacuum caused by high winds rushing over the roof in conjunction with the pressurized interior of the building can cause the roof to be pulled off from its supporting structure. In extreme weather regions, such as in the hurricane ravaged areas of Florida, rigorous testing standards are being employed in new building codes to address the structural damage caused by hurricanes due to inadequate building construction. For example, testing in Dade County subjects windows and skylights to pressure testing of 4500 inward and outward wind pressure cycles to simulate a hurricane wind flow against a building as the eye of the storm passes. Thus, the challenge for glazing panel manufacturers is to design products that meet the new rigorous codes. One such standard adopted in most of the Southeast is that established by the American Society of Civil Engineers, ASCE-7, which can dictate design pressures of more than 100 psf (pounds per square foot) for high coastal buildings.

In a particular glazing panel system of interest herein, the glazing panels are provided with upstanding seam flanges which extend along their side edges for being connected with adjacent panels with batten-type joining connectors. The seam flanges are provided with projecting saw teeth and the battens have internal saw teeth so that when the batten is pushed over abutting seam flanges of adjacent panels, the saw teeth of each cooperate to snap-fit the saw teeth together joining the adjacent panels.

Retention clips are used to keep joined panels anchored to the roof framework or supporting structure therebelow. Accordingly, the integrity of the roofing panel system relies on the clip to keep the roof secured in place during high wind load conditions. The clips that are currently used in the above-described panel system are very small and are die stamped from sheet metal, such as stainless steel and have a thickness of approximately 0.8 mm. The clips are placed between the seam flanges which are then joined by the batten snap fit thereover. A small base of the clip can then be fastened to the purlin or rafter of the supporting structure. The clips are small enough so that they are hidden from view by the supporting framework and between the seam flanges. However, the current small, stamped clips are not particularly well-suited for the high wind loads such as seen in Dade County and other hurricane regions. Accordingly, there is a need for a high performance glazing panel system and a retention clip therefor that are effective to keep the panel system anchored in place when subjected to high loads, such as due to the forces generated by high winds during hurricanes.

SUMMARY OF THE INVENTION

In accordance with the present invention, a glazing panel system having light transmission is provided which can withstand very high loads, such as an excess of 500 psf or 100 mph wind speed. The panel system herein is very sturdy and rigid so that it readily meets rigorous code requirements, such as those in effect in Dade County. The glazing panel system is anchored to a supporting structure such as on a framework of rafters and purlins. Joining connectors or battens are attached over upstanding seam flanges of adjacent panels with the retention clips of the present invention disposed between the seams and secured to the panel system framework. The present retention clips have top flanges thereof that provide the clip with improved holding power so as to prevent panels from coming loose from under the top flanges thereof and sliding out from the joining connectors during high wind loading of the glazing panel system herein.

In the preferred form, the retention clip is an extruded aluminum body which has an integral bottom flange and an integral central web that is to be disposed between the upstanding seam flanges. The bottom flange is secured by fasteners such as to a purlin of the supporting structure. It is preferred that the clip top flange which overlies the upstanding seam flange be longer than the bottom flange. In other words, the top flange can abut the tops of the seam flanges over a distance that is greater than the transverse width of the supporting structure, e.g. purlins, to which the clips are fastened to provide improved holding power.

The integral extrusion of the clip herein allows it to be formed in a wide variety of shapes and sizes in an economical fashion. In one form, the retention clip extends the full length of the rafter between adjacent purlins so as to provide greater retention capability and to separate adjacent glazing panels along their length between adjacent rafters. In this manner, the separated panels do not contact each other so as to minimize the friction and the forces generated inside the glazing panel system, reducing the noise associated with contacting panels such as during high wind conditions or thermal expansion.

In another form, the clip is provided with first and second spaced webs which depend from the top flange so as to separate adjacent upstanding seam flanges more than if there was just one single web therebetween. By varying the spacing between the webs, the center-to-center distance between adjacent panels is varied, providing flexibility for architectural design purposes.

The retention clip can be formed so that it has structural capabilities to reduce the amount of the supporting structure to which the panel system is normally anchored. For example, the retention clips can be formed integrally with the rafters so that the number of separate purlins of the supporting framework can be reduced for improved economics in architectural design.

In another form of the invention, a clip is provided for architectural panel members having upstanding seam flanges connected by a batten-type joining connector. The clip includes a central web portion having side bearing surfaces for being disposed between adjacent panel members and extending between connected seam flanges thereof. A top flange extends transversely on top of the central portion from one side of the central portion continuously to the other side thereof so that with seam flanges of adjacent panels members connected by the joining connector, the top flange engages over one adjacent panel seam flange on one side of the clip central portion and engages the other adjacent panel seam flange on the other side of the clip central portion to stiffen and reduce or eliminate the friction generated between connected panel members when subject to loading.

In a preferred form, the clip includes a bottom flange which extends transversely below the clip central portion for being fastened to a supporting structure under connected panels with the top flange keeping connected panel members secured to the supporting structure against forces tending to deflect the panel members and separate them from their joining connectors.

In one form, the web portion includes an integral transverse base, and the top flange is larger then the base flange with the bearing surfaces of the central web portion flaring out from the base flange to the top flange so that the bearing surfaces have a trapezoidal shape with increased contact area for the panels engaged therewith. The large top flange holds the panels securely against the supporting structure to minimize shifting of the panels when subject to heavy wind loads.

As previously mentioned, the clip can be an integral extrusion, and in one form, the base and top flange of thereof are thickened in cross-section to increase the inertia moment of the clip increasing its structural performance. In another form, the clip base has a tubular cross-sectional configuration to increase the moment of inertia of the clip and reduce the amount of distinct supporting structure underneath the panels.

DETAILED DESCRIPTION OF THE PREFERRED EMBODIMENTS

Figure 1:
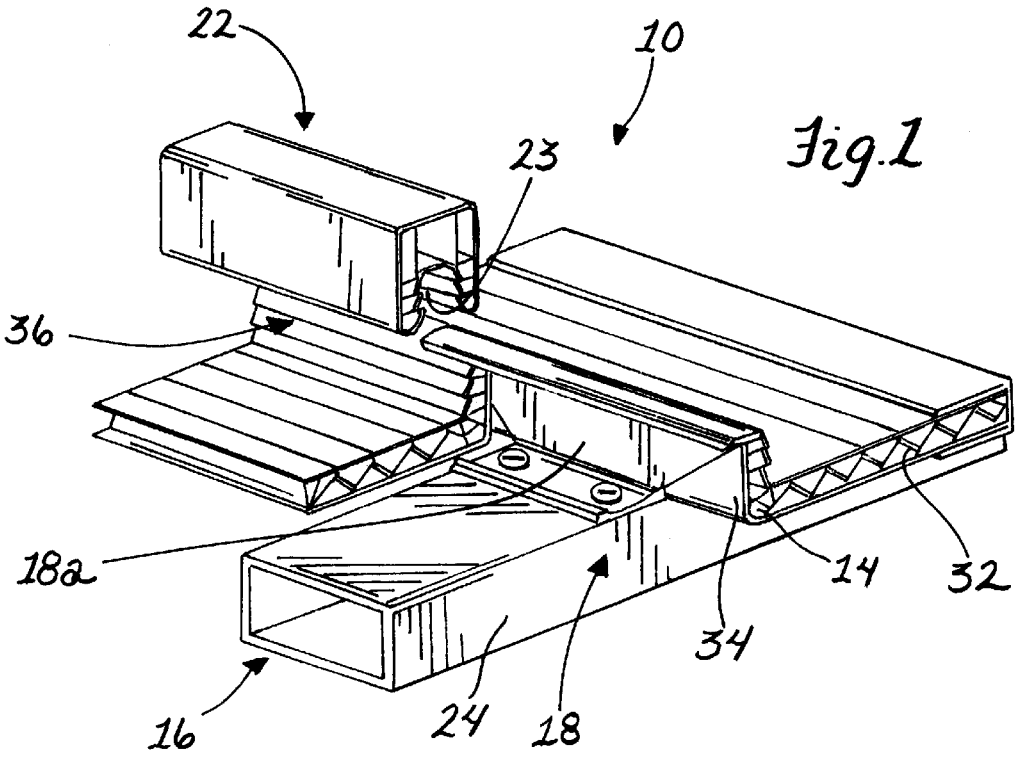
FIG. 1 is a perspective view of a glazing panel system in accordance with the present invention showing a retention clip fastened to supporting substructure with adjacent panel members on either side of the clip.
Figure 2:
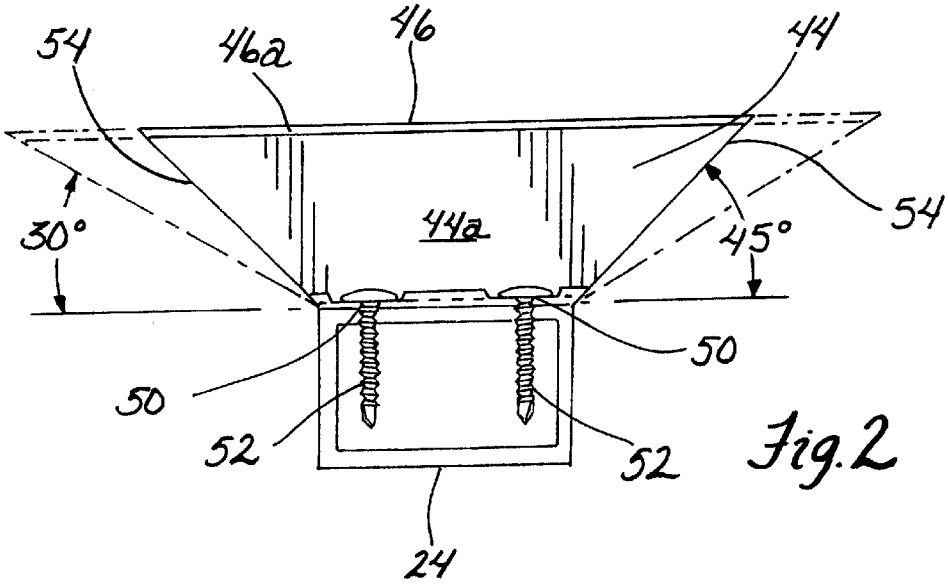
FIG. 2 is a side elevational view of the retention clip secured to the supporting structure and showing the enlarged top flange of the clip relative to the base thereof.
Figure 3:
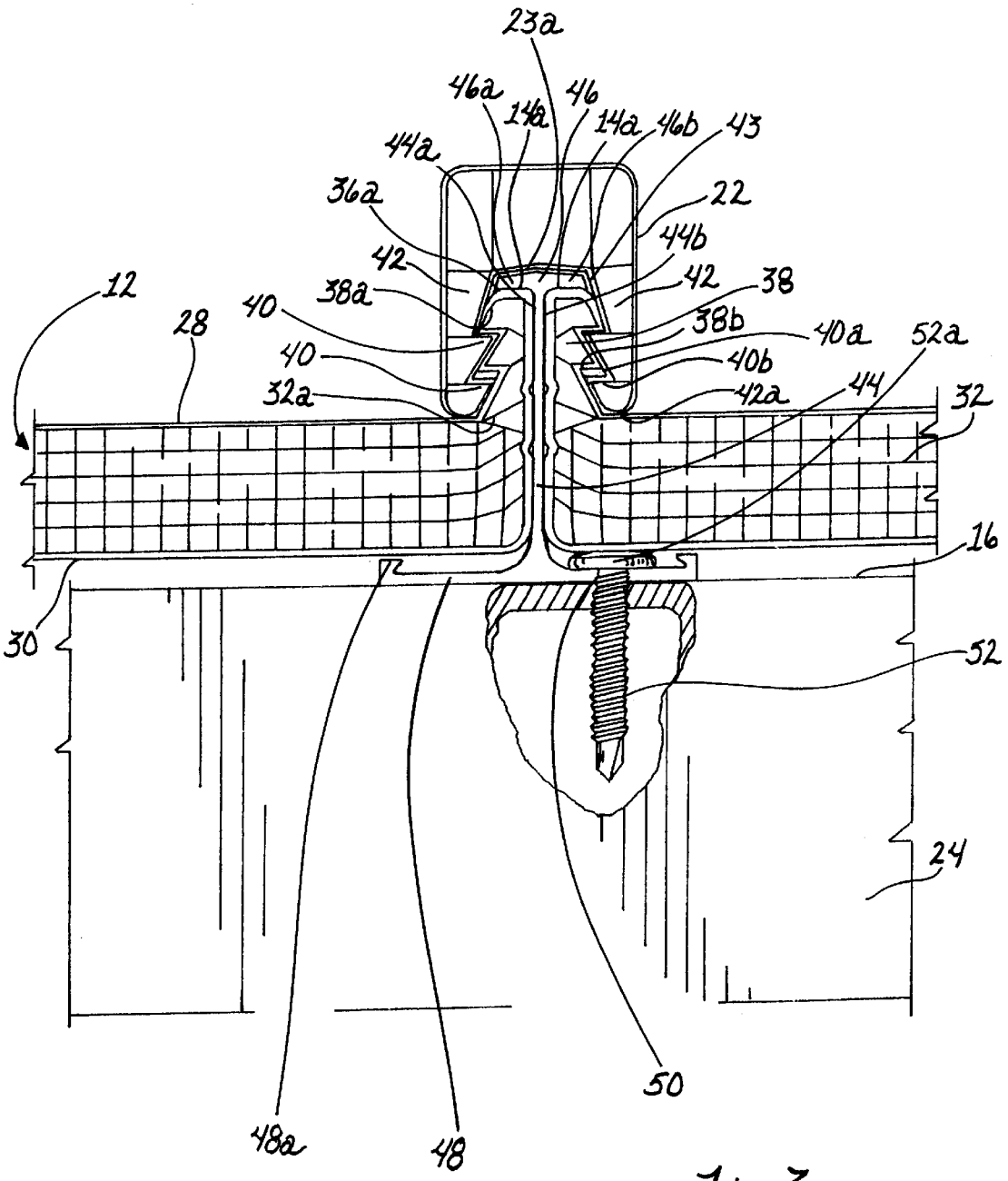
FIG. 3 is a sectional view of the assembled glazing panel system in accordance with the present invention showing seam flanges of adjacent panels having a batten connector snap fit thereover with the joined glazing panel members anchored by way of the retention clip to supporting substructure therebelow.

In FIGS. 1–3, an architectural glazing panel system 10 in accordance with the present invention is shown and includes modular extruded, glazing panel members 12 that are joined together along their upstanding seam flanges 14. The glazing panel members 12 as shown and described herein have a rectangular shape with their seam flanges 14 extending on either side thereof along their length. Generally, the panels 12 are approximately two feet to four feet in width and can be up to forty feet in length. It will be recognized other sizes and forms of panels 12 and associated seam flanges 14 can be used within the purview of the present invention.

Figure 13:
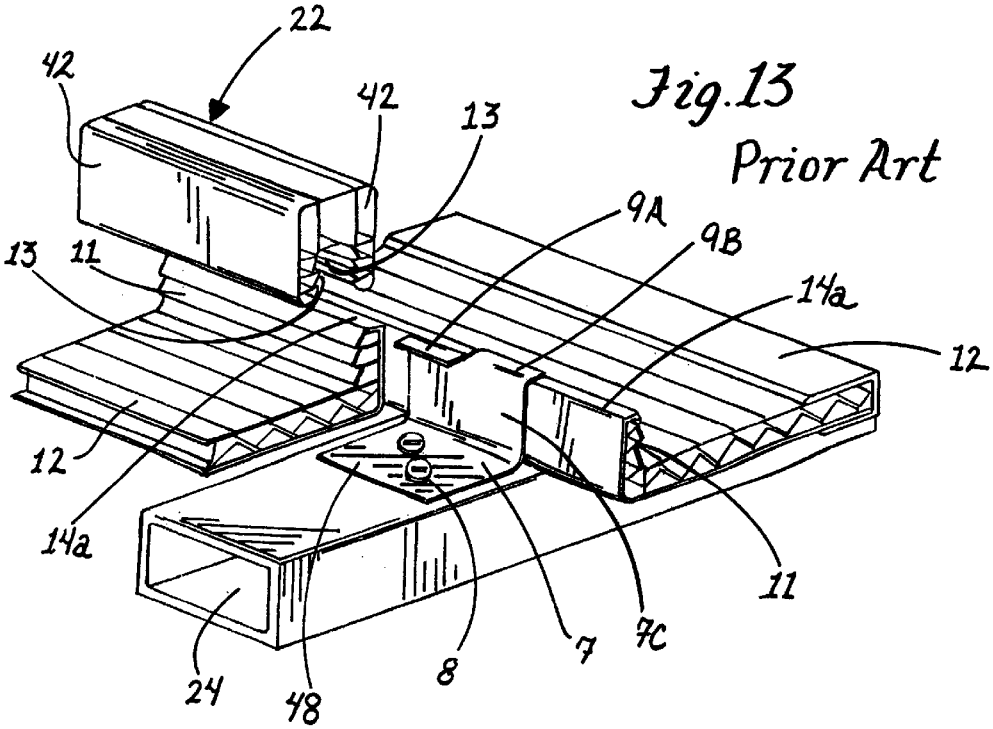
Fig. 13 Prior Art
FIG. 13 is a perspective view of a glazing panel system employing a prior art retention clip between adjacent panel members.

In the prior art, a retention clip 7 (FIG. 13) made of a thin sheet of metal has a base flange 48 which is fastened to an underlying purlin 24 by screw fasteners 8. The retention clip has a pair of small bent flanges 9A and 9B with each flange 9A and 9B overlying the top 14*a* of an upstanding seam flange 14. The clip is made of bent metal of 0.8 mm thickness. With high hurricane-type winds, the large surface area of the outside surfaces of the glazing panel results in large forces being applied to the flexible glazing panels that bend the small flanges 9A and 9B back to being closer to a vertical position in line with a vertical web 7C of the clip. The flanges 9A and 9B are only one-half of the width of the clip's base flange 48. When the clip flanges 9A and 9B are bent, saw teeth 11 on the seam flanges 14 are peeled from saw teeth 13 on inverted channel-shaped, batten members 22, with depending batten legs 42 being bent and flexed outwardly. The bending of the small clip flanges 9A and 9B and the peeling of the saw teeth 11 from the batten saw teeth 13 allow the glazing panels to be lifted from the purlins 14.

In accordance with the present invention, the glazing panels 12 are held to meet above normal wind forces and even the previously-described hurricane wind forces by new, improved retention clips 18 made with a pair of much wider retention flanges 46 and 46*a* which extend preferably the length of the entire width of the purlin 24 or even further. To provide greater strength to the small, stamped and bent metal clips 7 (FIG. 13) of the prior art, the preferred clips 18 are extruded metal clips with integral, non-bent flanges 46 and 46*a* overlying the tops 14*a* of the seam flanges 14 of the glazing panels 12. The preferred thickness of each of the flanges is usually within the range of 1.0 to 5.0 mm and the thickness of the web 44 is between 0.8 to 3.0 mm.

Supporting structure 16 is provided for mounting the panel members 12 thereon in a predetermined orientation for use in sloped roof constructions such as with standard gable type roofs, or with barrel vaulted roofs, multi-sloped roofs, etc. A retention clip 18 holds the panels 12 securely to the structure 16, and is disposed between the seam flanges 14 of adjacent panel members 12. The clip 18 keeps the panel members 12 in their predetermined orientation mounted to their supporting structure 16 to provide a high performance glazing panel system 10 that can withstand high negative loading such as those created by high winds, e.g. over 100 mph, during hurricane storms.

The panel members 12 are joined at their upstanding seam flanges 14 by a joining connector or batten 22 which is snap-fit over the seam flanges 14 to cover the seam formed therebetween. The above-described glazing panel system 10 utilizing the retention clip 18 herein for holding the panels 12 to the substructure 16 has undergone extensive testing and exhibited resistance to very high wind loads, i.e. in excess of 50 psf or wind forces of 100 mph. Such load bearing characteristics are substantially greater then that required by building codes that have adopted the rigorous ASCE-7 Standard which specifically addresses hurricane protection. Accordingly, the present glazing panel system 10 is effective to provide a high performance system where the panels 12 stay secured in place and do not come loose from under the clip 18 and slide out from their batten joining connectors 22 even when subjected to very high wind loading.

The supporting structure 16 for the panel members 12 typically includes horizontal framing members or purlins 24 and/or vertical or sloped frame members or rafter members 26 (FIG. 5) that can be interconnected together. These structural members 16 may be of wood or other materials or are usually manufactured from any suitable metal forming process, e.g. casting, rolling, extruding, etc., and can take on various forms. The members 16 can be of the seamless tube type with a polygonal rectangular cross-sectional configuration as illustrated or can be of the I-beam type or any other suitable form.

In one typical arrangement of the glazing panels 12 and their supporting structure 16, the rectangular panel members 12 will lie on the purlins 24 with the smaller ends of the panels 12 being laid parallel to the purlins. The rafters 26 support the purlins 24 thereon with a purlin 24 crossing a rafter 26 in perpendicular relationship therewith such as at every four feet along the length of the rafters 26. The rafters 26 will extend generally parallel to the long sides of the panels 12, and can be spaced from an adjacent rafter 26 such as by three or four panels 12 therebetween. The rafters 26 support the purlins 24 and attached panels 12 at an incline corresponding to the desired pitch of the building roof for which the present glazing panel system 10 can be utilized. One consideration when anchoring the glazing panels 12 to the understructure 16 with the retention clips 18 herein is that the clips 18 remain hidden from view for aesthetic reasons. With the above-described roof construction, retention clips 18 can be provided at every intersection of the upstanding seam flanges 14 of the glazing panels 12 with the purlins 24 for being attached thereto with the fastened clips 18 being hidden by the purlins 24 thereunder. For more rigidity of the joined panels 12, the clips 18 can be extruded so as to extend continuously between seam flanges 14 of adjacent panel members 12, as will be discussed more fully hereinafter.

The framework of purlins 24 and rafters 26 can be varied widely from that set forth above as dictated by functional and architectural design considerations. For example, rafters 26 can be more closely spaced so as to run along each panel seam 14 with reduced numbers of purlins 24 so that there is increased spacing between adjacent purlins 24. In this instance, instead of being attached to the purlins 24, the clips 18 can be fastened directly to the rafters 26 so as to be hidden thereby and at any selected spacing therealong. The panels 12 themselves could be oriented differently as well so that the rectangular panel members 12 run lengthwise parallel to the horizontal purlins 24 and perpendicular to the inclined rafters 26. In this instance, the spacing of the purlins 24 can be such that they run along the seams between adjacent sideways oriented panels 12 under the joined seam flanges 14 thereof so that the clips 18 can be spaced at any selected spacing along the purlins 24 for being attached thereto. The preferred retention clip 18 is an integral extrusion that is readily adapted for use with various types and configurations of panels 12 and supporting understructure 16 to form a high performance panel system 10 in accordance with the present invention.

Referring more specifically to FIGS. 1 and 3, it can be seen that the panel members 12 are preferably extruded with upper and lower sheets 28 and 30 interconnected by inner ribs 32 which extend transverse to the flat sheets 28 and 30. The panel sheets 28 and 30 and ribs 32 are made of materials that allow light transmission therethrough such as transparent or opaque plastics that may be colored or otherwise tinted. The upstanding seam flanges 14 of the panels 12 extend substantially perpendicular to the upper and lower sheets 28 and 30 along an edge thereof. More particularly, an exterior face 34 of the seam flange 14 is bent upward from the lower sheet 30 generally at right angles thereto, and an inner face 36 of the seam flange 14 is likewise bent upward from the upper sheet 30 generally at right angles thereto so that the faces 34 and 36 are spaced with inner ribs 32*a* connected therebetween to form the upstanding seam flanges 14.

The inner faces 36 of the seam flanges 14 have a plurality of saw teeth 38 for cooperating with opposing complementary saw teeth 40 of the batten joining connector 22. The batten joining connector 22 is of an elongated inverted U-shaped form having an interior channel 23 and with the saw teeth 40 thereof provided on facing surfaces of opposing legs 42 in the batten channel 23. The spacing of the batten legs 42 is sufficient to allow seam flanges 14 of a pair of adjacent panels 12 to fit therebetween. Thus, to join adjacent panel members 12, the batten 22 is pushed onto and over adjacent upstanding seam flanges 14 until they are fully inserted in the batten channel 23 between the legs 42 with bottoms 42*a* of the batten legs 42 abutting the top sheets 28 of adjacent panels 12. The batten channel 23 is of a depth sufficient to provide spacing 43 between the tops 14*a* of the seam flanges 14 and the base 23*a* of the batten channel 23. The seam flanges 14 are inserted into the batten channel 23 by way of resilient camming engagement of the inclined ramp surfaces 38*a* and 40*a* of the seam flange saw teeth 38 and the batten saw teeth 40, respectively. The batten teeth 40 cam over and past the flange teeth 38 with the batten legs 42 resiliently rebounding as their teeth 40 pass over the flange teeth 38. In this manner, the batten 22 is pressed or snap fit over the seam flanges 14 so that the flat shoulder surfaces 38*b* and 40*b* of corresponding opposite flange teeth 38 and batten teeth 40 are in confronting relation so as to prevent the batten 22 from being pulled off from the seam flanges 14 in a direction away from the panel members 12.

Figure 6:
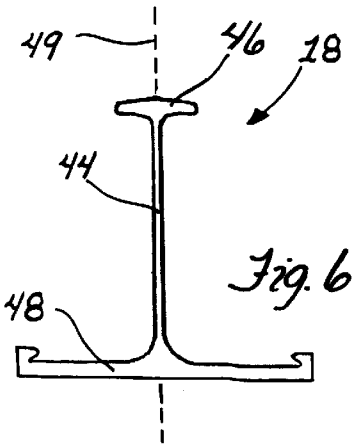

Turning to the construction of the high-performance retention clip 18, it is preferred that the retention clip 18 be formed as an integral extrusion with a lightweight aluminum body 18*a*. The clip body 18*a* includes a central web portion 44 and a top flange 46 which extends continuously across the upper end of the web portion 44 from one side of the web 44 to the other side thereof, as best seen in FIGS. 3 and 6. Thus, the top flange 46 has a first section 46*a* which extends perpendicular from the top of one side 44*a* of the web portion 44 and has a second section 46*b* that extends perpendicular from the top of the opposite side 44*b* of the central web portion 44 with the top flange sections 46*a* and 46*b* being integral and contiguous with each other along the top of the central web portion 44.

The clip 18 is installed between joined seam flanges 14 with the top flange 46 thereof residing in the channel space 43 between the base 23*a* of the batten channel 23 and the tops 14*a* of the seam flanges 14. In this manner, the top flange 46 of the clip 18 extends continuously across the web 44 for engaging continuously across the tops 14*a* of adjacent seam flanges 14 for the entire extent of the clip top flange 46 in the space 43 in the batten channel 23. The continuous nature of the clip top flange 46 across the web 44 positions more flange material on top of the seam flanges 14 so that the panels 12 are held with increased holding power on their supporting structure 16, and the top flange 46 is more resistant to being bent up on either side of the web 44 to prevent the confronting flat teeth surfaces 38*b* and 40*b* of the seam flanges 14 and battens 22, respectively, from being pulled and slipping past each other. Accordingly, the clips 18 herein are better able to prevent the panels 12 from coming loose from under the top flange 46 and from sliding out of the battens 22 during extreme wind loading conditions such as can occur during hurricanes.

The clip 18 has an integral base or bottom flange 48 that extends transverse to the web portion 44 at the bottom thereof for being fastened to the understructure 16 therebelow. Preferably, similar to the top flange 46, the base flange 48 extends from one side of the web portion 44 to the other side thereof such that the clip 18 is symmetrical about a central vertical axis 49 extending through the web portion 44 thereof. Accordingly, the clip 18 has an I-beam type cross-sectional configuration to provide it with a very strong extruded structure having good rigidity against applied bending forces. The vertical spacing between the clip top flange 46 and its base 48 along the web 44 is substantially equal to or slightly greater than the vertical height of the seam flanges 14 along their exterior faces 34 so that adjacent seam flanges 14 are tightly received between the continuous top flange 46 and the base 48 attached to the substructure 16. Thus, with the seam flanges 14 tightly fitted under clip top flange 46 the long continuous top flange 46 will keep the confronting teeth surfaces 38*b* and 40*b* in tight engagement with each other, and will restrain the surfaces 38*b* and 40*b* from being pulled past each other during heavy winds.

As shown, the bottom flange 48 can be longer in the direction extending transverse and across the web portion 44 than the top flange 46 to provide a large base for resting on and being fastened to the supporting structure 16, as best seen in FIGS. 3 and 6. The base flange 48 is provided with a pair of apertures 50 for receiving fastener members 52 therethrough and down into the supporting structure 16 therebelow for fastening the clip 18 thereto, as best seen in FIGS. 2 and 3. The base flange 48 can be extruded with raised panel engaging edges 48*a* along each side of the base 48 that are slightly higher than the top surface of the base 48. When the system 10 herein is assembled with the clips 18 fastened to the structure 16, the bottom panel sheet 30 will be supported over the base 48 on the raised edges 48*a* thereof. In this manner, the lower sheet 30 clears the enlarged heads 52*a* of the fastener members 52 screwed down onto the top of the base flange 48 so that the heavy weight of the panels 12 is not resting against the screw heads 42*a* thus limiting or avoiding potentially damaging contact therebetween.

Continuing reference to FIG. 2, there it is shown that the top flange 46 can be provided with a variety of lengths in the direction running along the length of the upstanding seam flanges 14 so as to increase the amount of material of the clip flange 46 engaged over and along the tops 14*a* of the seam flanges 14 thus increasing its ability to hold and minimize the deflection of the panel members 12 thereunder when subject to heavy wind loading. More particularly and as previously mentioned, the main limitation on the use of the retention clips 18 is the understructure 16 that is utilized as typically it is desired that the retention clip 18 be hidden from view. Thus, with the above in mind, where the clip 18 is to be attached to supporting structure 16 that extends transverse to the clip web portion 44 as shown in FIGS. 1–3, the width of the bottom flange 48 can be substantially equal to the width of the supporting structure 16, e.g. purlin 24, such as approximately two inches in width and still be concealed by the purlins 24. On the other hand, the length of the top flange 46 of the present extruded clip 18 can be made to be much longer than the base 48 so that it extends beyond the purlin 24 as it is on top of the seam flanges 14 and thus cannot be seen.

With the clip 18 fastened to the purlin 24 and the outer faces 34 of upstanding seam flanges 14 of adjacent panel members 12 abutting respective bearing surfaces 44*a* and 44*b* of the clip web portion 44, the long sections 46*a* and 46*b* of the clip flange 46 will be in engagement over the tops 14*a* of the upstanding seam flanges 14, as best seen in FIG. 3. Due to the increased length of the flange sections 46*a* and 46*b* and their continuous nature in extending over the integral web 44 and the rigid extrusion of the clip 18, the sections 46*a* and 46*b* are more resistant to being bent upward when a roof structure utilizing the glazing panel system 10 herein is subject to vacuum forces produced by high wind loading which tries to pull the panel members 12 off from the supporting structure 16. Thus, the continuous flanges may span and engage the seam flanges 14 over forty-eight inches between adjacent purlins rather than engaging only a few inches, as in the prior art. This results in greater strength and holding power for the clip.

An additional advantage afforded by the present extruded clip 18 is that it is effective to reduce or eliminate the amount of contact between adjacent upstanding seam flanges 14, and specifically the outer faces 34 thereof when the panels 12 are secured or anchored to the supporting structure 16 with the present clips 18 herein. As discussed above, the base flange 48 can be smaller than the top flange 46 so that the long top flange 46 provides the clip 18 with improved holding power. In this instance, the retention clip 18 is formed so that the side bearing faces 44*a* and 44*b* of the clip web portion 44 have increased surface area for engagement with the seam flange outer faces 34 to further minimize the chance of any rubbing contact between the adjacent seam flanges 14 such as during high winds while still keeping the clip 18 substantially concealed from view. Because only the relatively thin web portion 44 extends beyond the width of the supporting structure 16 and since it is sandwiched between seam flanges 14 of the panels 12, the clip 18 is still substantially hidden from view as it will be virtually impossible to see the thin webs 44 between the seam flanges 14 when viewed from a distance as when the glazing panel system 10 is utilized in overhead roof constructions.

As best seen in FIG. 2, the side bearing surfaces 44*a* and 44*b* can be provided with an inverted trapezoidal shape so that they flare out from the base flange 48 to the enlarged top flange 46. In the preferred extruded clip 18 utilized in the glazing panel system 10 herein which has withstood wind load testing of wind forces in excess of 100 mph or in excess of 50 psf. Opposite ends 54 of the web portion 44 were flared at an incline of approximately 45° so that where the base flange 48 extends two inches in the direction along the seam flanges 14, the top flange 46 is approximately four inches in length in the same direction. For increased bearing surface area and reach of the top flange 46 along the tops 14*a* of the seam flanges 14, the angle can be varied such as by providing an incline of 30° from the horizontal, as shown in ghost in FIG. 2. Because the bearing surfaces 44*a* and 44*b* extend further between the outer faces 34 of adjacent upstanding seam flanges 14, the clip 18 herein reduces or eliminates the intermittent contact that can be generated between the seam flanges 14 so as to reduce the noise or chatter created during high wind storms in the panel system 10. Also, this reduces noise generated by the contact between seam flanges generated with expansion and contraction of the panels. In addition, the clip 18 having large side bearing surfaces 44*a* and 44*b* has the previously-described enlarged top flange 46 to provide the clip 18 with greater holding power to minimize deflection and shifting of the panels 12 during heavy wind loading.

Figure 7:
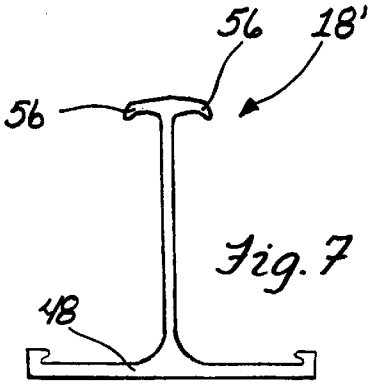

Turning to FIGS. 7–10 various alternative constructions for the retention clip 18 are shown. In FIG. 7, clip 18' shows a slightly modified top flange 46 wherein the outer side edges 56 are shown as being downwardly inclined to abut against the upstanding seam flanges 14. The depending side edges 56 grip against the tops 14*a* of the seam flanges 14 adjacent the inner faces 36 thereof. Thus, the side edges 56 grip around corner 36*a* formed at the junction of the top of the seam flange inner face 36 and the seam flange top surface 14*a*. In this manner, the clips 18 can exert an outwardly directed holding force when negative loads try to pull the panel 12 away from the clip bearing surface and out from under the clip top flange 46. Thus, the depending side edges 56 serve to ensure that the seam flange outer face 34 is maintained against the bearing surfaces 44*a* or 44*b* of the clip web 44 so as to increase the clip's holding power in maintaining the panels 12 anchored against the supporting structure 16 during wind loading.

Figure 8:
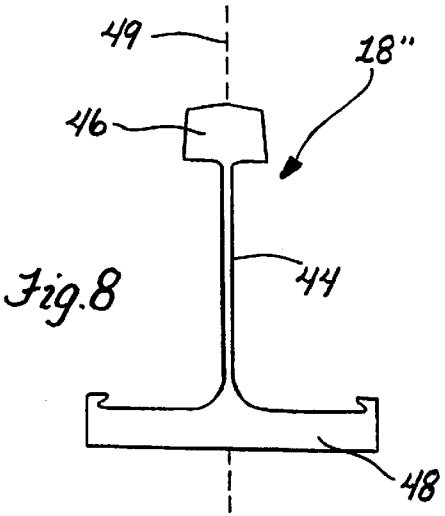

FIG. 8 illustrates retention clip 18" having its corresponding top flange 46 and its base flange 48 thickened relative to the central web 44 so that there is more clip material on either side of the central axis 49 about which the clip 18*a* is symmetrical. In this manner, the clip 18' has an increased moment of inertia thus reducing the amount of deflection in the glazing panel system 10 when subject to high wind loading. In other words, the thickened clip 18" will be more resistant to being bent, thus making the glazing panel system 10 utilizing clip 18" more rigid and resistant to deflection. Because the clip 18 herein is preferably formed as an integral extrusion, the thickening of the top flange 46 and base flange 48 can be readily accomplished in a cost effective manner by simply changing the configuration of the extrusion die of the extruding mechanism for providing the clip 18" with an increased moment of inertia.

Figure 10:
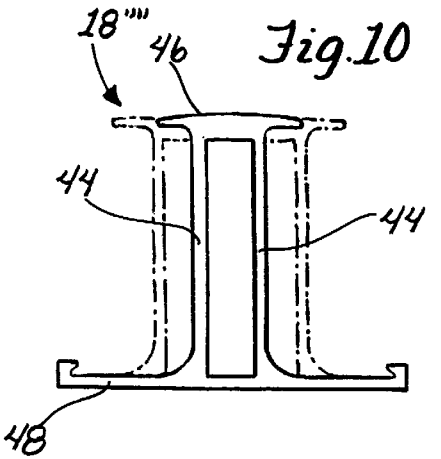
FIGS. 6–10 are elevation views of various forms of integrally extruded retention clips in accordance with the present invention.

Another clip 18"" in accordance with the invention is shown in FIG. 10. The clip 18"" has a pair of spaced central webs 44 against which the upstanding seam flanges 14 of adjacent panel members 12 abut thereby increasing the center-to-center spacing between the adjacent panel members 12 over panels utilized with the single, thin web clip 18. Again, with the integral extrusion herein, the spacing of the web members 44 can be readily varied by simply changing the extrusion dies so that the clip 18"" is tailored to the precise panel spacing that is desired. In this manner, the clip 18"" offers a significant degree of flexibility in the design of glazing panel systems 10 in accordance with the present invention.

Figure 4:
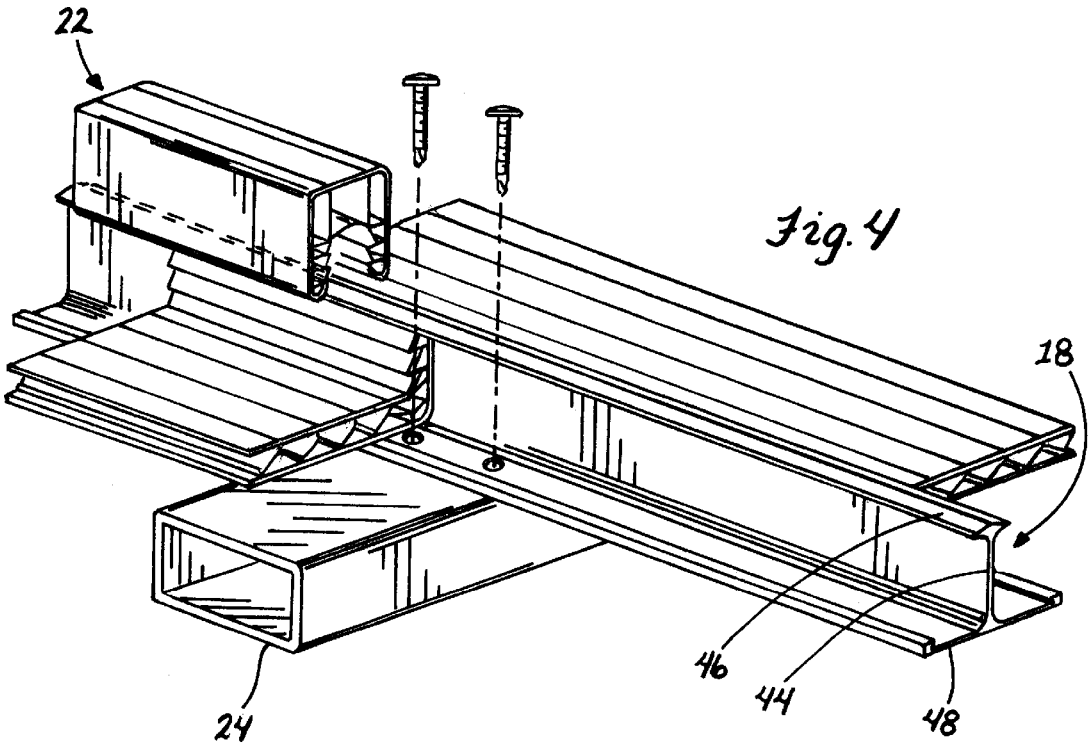
FIG. 4 is a view similar to FIG. 1 showing an alternate form of the retention clip which extends continuously between upstanding seam flanges of adjacent panels.
Figure 5:
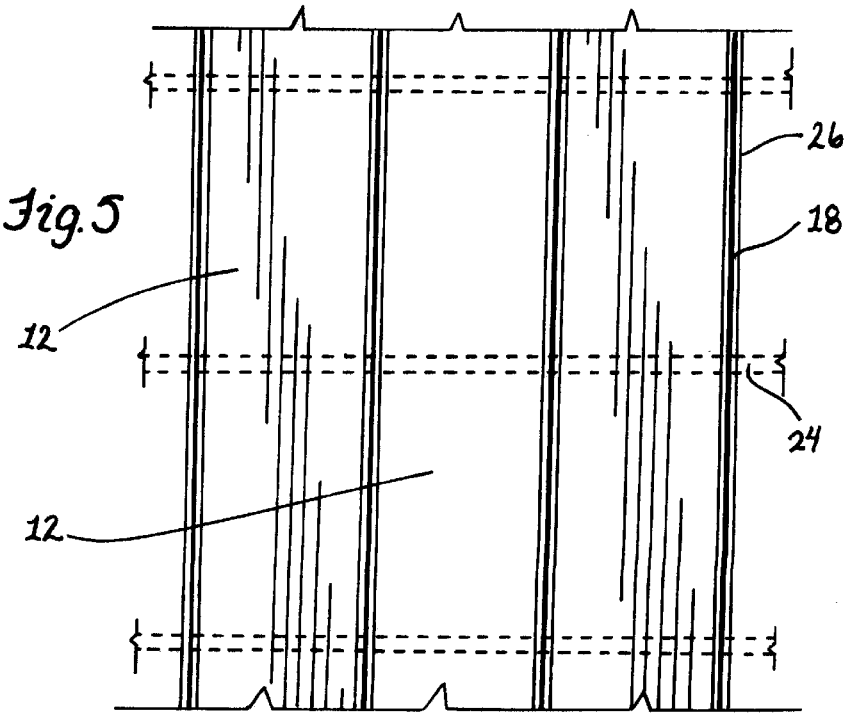
FIG. 5 is a plan view of supporting framework for the panel system utilizing the continuous retention clip as shown in FIG. 4.

As previously mentioned, the retention clip 18 can be formed so that it extends continuously between adjacent panels 12 so that the clip web portion 44 extends continuously between adjacent seam flanges 14 along the entire length thereof. If the purlins 24 extend transverse to the web portion 44 such a continuous clip 18 will extend beyond the purlins 24 to which they are fastened, as shown in FIG. 4. Where exposure of the continuous clip 18 is undesirable for aesthetic purposes, architectural trim material can be secured about the exposed base flange 48 of the continuous clip 18. If the structural system 16 has purlin or rafter members spaced to extend along each seam between the panel members 12, the continuous clip 18 will run along the structural members 24 or 26 so as to be hidden from view thereby, as seen in FIG. 5 where continuous clips 18 are shown secured to rafters 26 that run along the seams between adjacent panels 12.

Figure 9:
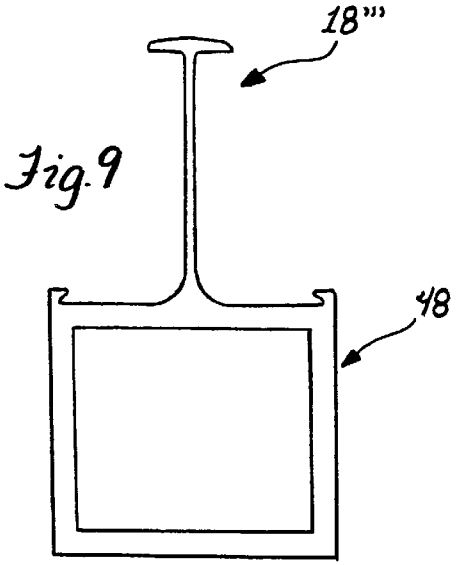

It is also possible to form the continuous clip 18 so that it has a enlarged base flange 48 such as with a square tubular cross-sectional configuration, as shown with the clip 18'" of FIG. 9. Where the clip 18'" is utilized in a supporting structure system 16 such as shown in FIG. 5, the enlarged bottom flange 48 can serve as part of the supporting structure so as to eliminate the need to provide distinct structural members running therebelow. So, for instance, if the purlins 24 normally run along the seams between adjacent panel members 12 under the seam flanges 14 thereof, the clip 18'" is formed such that it is integral with the purlins 24 thus eliminating the need for separate, distinct purlins crossing the rafters 26. Alternatively, where the panels 12 have their orientation as in FIG. 5 with the rafters 26 running below adjacent seam flanges 14, the retention clip 18'" is formed so that it is integral with the rafters 26 eliminating the need for separate rafter members 26 crossing purlins 24. In addition, the enlarged base 48 provides the clip 18"" with an increased moment of inertia similar to thickened clip 18" so as to further resist bending or deflection of the panel members 12 when subjected to wind loading.

Figure 11:
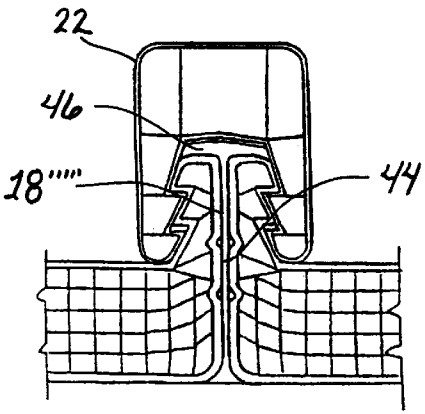
FIG. 11 is a sectional view similar to FIG. 3 of a glazing panel system having a clip without an extended base used for stiffening of adjacent joined panel members.

Retention clip 18 can also be extruded so that the base flange 48 is substantially reduced in size or eliminated as in clip 18"" of FIG. 11. In this manner, the baseless clip 18"" can be used to continuously extend between seam flanges 14 of adjacent panels 12 regardless of the arrangement of the understructure 16. In this manner, if there is no structure 16 below the glazing panels 12, the clip 18"" will not be readily visible as only the bottom of the relatively thin web 44 will be exposed for view between the upstanding seam flanges 14. While the clip 18"" does not serve to anchor the panel members 12 to supporting structure 16, such a continuous clip will make the connection between adjacent panels 12 provided by the battens 22 snap fit over the seam flanges 14 more rigid to stiffen the panels 12 and reduce deflection thereof when subjected to wind loads as the top flange 46 still extends continuously across the top of the central web 44 so as to engage over the seam flanges 14 on either side of the web 44 minimizing any potential for slippage of the confronting flat teeth surfaces 38*b* and 40*b* of the seam flanges 14 and battens 22 past each other.

Figure 12:
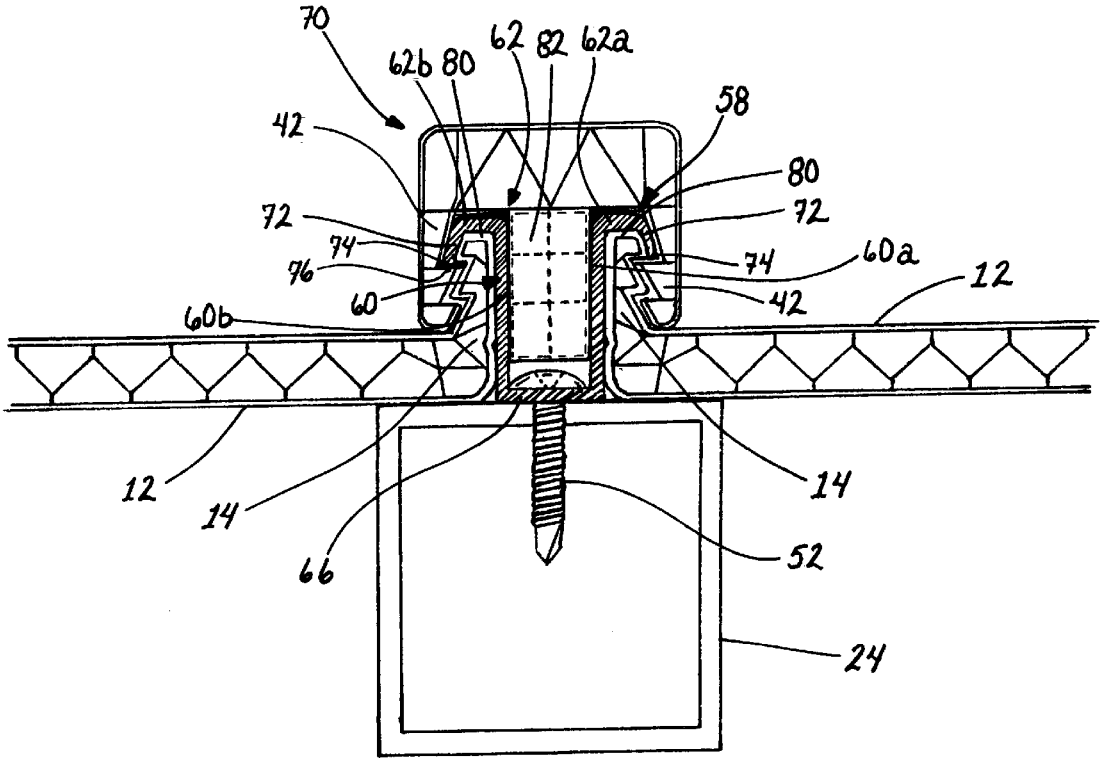
FIG. 12 is a sectional view of a clip and batten member constructed in accordance with another embodiment of the invention.

Referring to FIG. 12, an alternative form of clip 58, in accordance with the invention, is extruded and made of aluminum or the like with a top flange 62 having a pair of right and left flange portions 62*a* and 62*b*. The flange portions are connected to and extend outwardly from a central web portion 60 of the clip 58, with the web portion 60 having right and left vertical sections 60*a* and 60*b* integrally joined to the flange portions 62*a* and 62*b*. A base flange 66 extends transversely of and is integrally connected to the respective web sections 60*a* and 60*b*.

To aid in retention of the batten member 70, the clip flanges 62*a* and 62*b* have outer gripping edges in the form of downwardly-inclined edges 72 terminating at outer ends 74 on the flange portions 62*a* and 62*b*. Herein, each of the outer ends 74 abuts a tooth or serration 76 on the batten member legs 42 to hold the batten down. Each of the upper ends of the seamless flanges 14 of the panel members are fitted into a channel or slot 80 formed on the underside of the flange portions between the downwardly-inclined edges 72 and an adjacent, upper section of the web vertical sections 60*a* and 60*b*.

The illustrated batten member 70 is generally in the shape of the batten member 22 in the sense that it is an inverted channel-shaped member with depending legs 42; but the batten member 70 has a central, depending tongue 82 in the shape of a rectangular plate that is sized to fit in an upwardly-opening channel between upstanding web, vertical sections 60*a* and 60*b* of the clip 58. The depending tongue 82 adds mass and strength to the batten member 70 to resist the release of seamless flanges 14 during a windstorm. The base flange 66 of the clip is secured to the purlin 24 by a threaded fastener 52 or the like.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A glazing panel system for use with rafters and purlins and having light transmission to withstand forces of approximately 50 psf or 100 mph wind speeds, said glazing system comprising:

a plurality of glazing panels being for being supported by a framework of rafters and purlins each of the panels having top and bottom sheets thereof;

an upstanding seam flange at opposite ends of the panels extending upwardly from the top sheets of the panels and having a top side thereon, the upstanding seam flanges having exterior faces that are disposed parallel and adjacent to one another;

joining connectors fitted over the tops of adjacent seams and connecting the adjacent, upstanding seam flanges together and covering a seam formed between adjacent, glazing panels;

at least one retention clip disposed between adjacent, upstanding seams and having a base for being secured to the purlins to secure the glazing panels to the purlins;

a central web on the retention clip positioned between adjacent seam flanges at the location of the purlin; and a top flange on the retention clip abutting the top sides of each of said adjacent seam flanges over a distance about equal to or greater than the length of the base to retain the glazing panels against said forces, the central web having side bearing surfaces that are substantially flat and extend continuously between the top flange and base of the clip with the bearing surfaces having a predetermined height sized to substantially match that of the exterior faces of the seam flanges between the top sides of the seam flanges and the bottom sheet of the panels to allow the exterior faces to bear flush against the web bearing surfaces continuously therealong between the top flange and base of the clip.

2. A glazing panel system in accordance with claim 1 wherein the retention clip comprises an extruded aluminum body including the central web disposed between the upstanding seam flanges and the base comprising a bottom flange with the top and bottom flanges and central web being integral portions of the clip aluminum body.

3. A glazing panel system for use with rafters and purlins and having light transmission to withstand forces of approximately 50 psf or 100 mph wind speeds, said glazing system comprising:

a plurality of glazing panels being for being supported by a framework of rafters and purlins;

an upstanding seam flange at opposite ends of the panels having a top side thereon, the upstanding seam flanges being disposed parallel and adjacent to one another;

joining connectors fitted over the tops of adjacent seams and connecting the adjacent, upstanding seam flanges together and covering a seam formed between adjacent, glazing panels;

at least one retention clip disposed between adjacent, upstanding seams and having a base for being secured to the purlins to secure the glazing panels to the purlins;

a central web on the retention clip positioned between adjacent seam flanges at the location of the purlin; and a top flange on the retention clip abutting the top sides of each said of adjacent seam flanges over a distance about equal to or greater than the width of the base to retain the glazing panels against said forces, wherein the base comprises a bottom flange on the retention clip for resting on the purlin;

fasteners for securing the bottom flange of the retention clip to the purlin; and the top flange, overlying the upstanding seam flanges, is substantially longer than the bottom flange.

4. A glazing panel system in accordance with claim 3 wherein the clip top and bottom flanges and the central web each include ends, and inclined, sloped edges on opposite ends of the central web extend between the ends of the top flange and the ends of the bottom flange.

5. A glazing panel system in accordance with claim 1 wherein:

a second web is spaced from the first web, and is positioned parallel to and spaced from the first web on the retention clip; and the spaced webs separating adjacent upstanding seam flanges further apart at the seam than the thickness of a single web.

6. A glazing panel system in accordance with claim 1 wherein the retaining clip is integral with the rafter.

7. A glazing panel system in accordance with claim 1 wherein the retention clip is made of metal.

8. A glazing panel system in accordance with claim 1 wherein the retention clip is made of high performance plastic.

9. A glazing panel system in accordance with claim 1 wherein the retention clip extends the full length of the rafter between adjacent purlins and separates adjacent glazing panels along the length thereof between the adjacent purlins to provide a long length for holding the glazing panels against extreme load forces from the wind.

10. A glazing panel system in accordance with claim 1 wherein outer gripping edges on the top flange of the retention clip abut the upstanding seam flanges to improve the gripping and holding of seam flanges.

11. A glazing panel system in accordance with claim 10 wherein the outer gripping edges are inclined downwardly and overhang the upstanding seam flanges.

12. A glazing panel system in accordance with claim 1 wherein the central web comprises a pair of spaced vertical webs;

a pair of spaced top flanges are each integrally joined to one of the vertical webs; and a channel is formed between the vertical webs to receive a depending portion of the joining connector between the spaced vertical webs.

13. A glazing panel system having light transmission to withstand forces of 50 psf or from winds in excess of 50 mph and for use with rafters and purlins, said glazing system comprising:

glazing panels for being supported by a framework of rafters and purlins;

an upstanding seam flange at opposite ends of the panels having a top side thereon with the upstanding seam flanges being disposed parallel and adjacent to one another;

batten members of inverted U-shape fitted over the tops of adjacent seams and connecting the adjacent, upstanding seam flanges together and covering a seam formed between adjacent, glazing panels;

at least one retention clip having portions of non-uniform, cross-sectional thickness disposed between adjacent, upstanding seams for being secured to the rafters to secure the glazing panels to the rafters;

a central web on the retention clip positioned between adjacent seam flanges at the location of the purlin;

an integral base on the retention clip for securing to a rafter;

tooth snap-fit detents on the batten members and on the seam flanges for joining the glazing panels together with snap-fit batten members; and a top flange on the retention clip abutting the top sides of each of said adjacent seam flanges over a distance about equal to or greater than the width of the rafter to retain the snap-fit detents on the seam flanges from peeling loose from the detents on the batten members to withstand 50 psf or winds in excess of 50 mph with the central web having a predetermined height to position the top flange to engage tightly against the top sides of the adjacent seam flanges so that said engagement provides the primary resistance against pull forces tending to separate the tooth snap-fit detents of the batten members and seam flanges and the batten joined panels off from the framework of purlins and rafters.

14. The glazing panel system of claim 13 wherein the retention clip comprises an extruded body of aluminum;

with the base being an integral bottom flange on the retention clip for fastening to a purlin; and the top flange and central web also being integral with the bottom flange.

15. A clip for architectural panel members having upstanding seam flanges connected by a batten-type joining connector, the clip comprising:

a central web portion of the clip having side bearing surfaces for being disposed between adjacent panel members and extending between connected seam flanges thereof;

a base integral with the central web portion and having a predetermined length; and a top flange which extends integrally transverse to the base length on top of the central web portion continuously across the web portion to provide the top flange with a transverse width with the central web portion having a predetermined height sized so that the integral top flange engages over and tightly against one adjacent panel seam flange on one side of the clip central portion and engages over and tightly against the other adjacent panel seam flange on the other side of the clip central portion to stiffen the connected panel members.

16. The clip of claim 15 wherein the top flange and the central portion extend continuously between purlins and a rafter to provide a long length of retention area with the panel seams flanges to hold the panel members against wind generated forces; and the central portion maintaining spacing between adjacent connected panel members reducing friction and noise when the panel members are loaded and due to expansion and contraction of the panel members.

17. The clip of claim 15 wherein the clip central portion and the top flange are an integral extrusion with areas of varying cross-sectional thickness and for providing a low cost clip that can be matched to specific panel design criteria.

18. The retaining clip of claim 15 wherein the top flange is longer than the length of the base with the bearing surfaces of the central web portion flaring out from the base to the top flange so that the bearing surfaces have a trapezoidal shape with increased contact area for the panels engaged therewith; and the large top flange holds the panels securely connected together and against the supporting structure to minimize shifting of the panels when subject to heavy wind loads.

19. The retaining clip of claim 15 wherein the top flange has depending side edges which grip against seam flanges of adjacent panels for increased holding power to maintain the panels secured to the supporting structure.

20. The retaining clip of claim 15 wherein the central web portion includes a pair of spaced web portions with each web portion having an outer bearing surface for engaging a panel abutted thereagainst with the bearing surfaces of the pair of web portions being spaced at a predetermined distance.

21. The retaining clip of claim 20 wherein the pair of spaced webs define an upwardly, opening channel therebetween to receive a depending tongue of a batten member.

22. A retaining clip for holding architectural glazing panels securely against supporting structure in a predetermined orientation with the retaining clip being fastened to the supporting structure and fit between upstanding seam flanges of adjacent panels connected by a joining connector attached onto the seam flanges, the retaining clip comprising:

an extruded, one-piece body for the clip;

an integral, central portion on the clip body having opposite sides for bearing against adjacent panels and their joining flanges;

an integral base of the clip body with the central portion upstanding from the base to a top thereof; and an integral, top flange having a first section transversely extending from one side of the central portion and a second section transversely extending from the other side of the central portion with the first and second sections extending for a distance greater than the base to provide improved holding power in keeping the panels anchored when the panels are subject to heavy loads, the sides of the clip central portion including side bearing surfaces that are substantially flat and extend continuously between the top flange and base of the clip with the bearing surfaces having a predetermined height sized to substantially match that of the panel joining flanges to allow the joining flanges to bear flush against the bearing surfaces continuously therealong between the top flange and the base of the clip.

23. The retaining clip of claim 22 wherein the base is substantially flat and extends on either side of the clip central portion a first predetermined distance and the top flange sections extend on either side of the clip central portion a second predetermined distance less than the first predetermined distance to provide a wider base than top flange for being fastened to the supporting structure.

24. The retaining clip of claim 22 wherein the base and top flange are thickened in cross-section relative to the central portion to increase the inertia moment of the clip increasing its holding power.

25. The retaining clip of claim 22 wherein the base has a tubular cross-sectional configuration to increase the inertia moment of the clip and reduce the amount of distinct supporting structure underneath the panels.

26. The retaining clip of claim 15 wherein the base has a reduced size in a direction transverse to its length to minimize visibility thereof.

27. The retaining clip of claim 15 wherein the base has a width transverse to its length that is greater than the transverse width of the top flange for being connected to a roofing framework.

* * * * *